US005197233A

United States Patent [19]

Wiand

[11] Patent Number: 5,197,233

[45] Date of Patent: Mar. 30, 1993

[54] CUTTING TOOL WITH POLYCRYSTALLINE DIAMOND SEGMENT AND ABRASIVE GRIT

[76] Inventor: Ronald C. Wiand, 1494 Heatherwood Dr., Troy, Mich. 48098

[21] Appl. No.: 711,220

[22] Filed: Jun. 6, 1991

Related U.S. Application Data

[62] Division of Ser. No. 579,869, Sep. 6, 1990, Pat. No. 5,052,153.

[51] Int. Cl.[5] ..... B24B 1/00

[52] U.S. Cl. ..... 51/281 R; 51/323; 51/327; 407/32; 408/22

[58] Field of Search ..... 51/281 R, 323, 327, 51/5 C, 206 R, 209 R; 407/32, 34, 40, 53, 118, 119, 120; 408/22, 27, 144, 145

[56] References Cited

U.S. PATENT DOCUMENTS 4,589,805 5/1986 Duffner ..... 408/22
4,720,218 1/1988 DeFries et al. ..... 407/32
4,821,465 4/1989 Tomlinson et al. ..... 51/283 R
4,901,480 2/1990 Dillon ..... 51/209 R
5,000,630 3/1991 Riley et al. ..... 408/22

FOREIGN PATENT DOCUMENTS 5689416 7/1981 Japan ..... 408/22

*Primary Examiner*--M. Rachuba
*Attorney, Agent, or Firm*—Harness, Dickey & Pierce

[57] ABSTRACT

A novel construction of a single blade fly cutter type generator wheel. The wheel incorporates a single polycrystalline blade. The blade is counterbalanced by a cut-out portion. An abrasive grit material is provided on a surface of the wheel rim which follows the polycrystalline blade. The abrasive grit cooperates with the blade such that it breaks down large turnings generated by the blade during cutting operations to increase efficiency of the wheel and allows the use of only one blade. An improved method for drilling or cutting of composites is provided wherein softer layers of the composites are not adversely affected during the cutting or drilling operation.

2 Claims, 2 Drawing Sheets

CUTTING TOOL WITH POLYCRYSTALLINE DIAMOND SEGMENT AND ABRASIVE GRIT

This is a division of patent application Ser. No. 07/579,869, filed Sep. 6, 1990, now U.S. Pat. No. 5,052,153, patented Oct. 1, 1991.

BACKGROUND OF THE INVENTION

The present invention relates to a cutting tool with polycrystalline and abrasive grit cutting surfaces. More particularly, the present invention relates to a fly cutter type generator wheel having a single polycrystalline diamond cutting segment and improved methods for cutting of materials.

Fly cutter type generator wheels have been provided in the past for rough cutting of ophthalmic lens curvatures. Such prior art generator wheels generally include two or more polycrystalline diamond cutting blades for providing a rough grade cut in an ophthalmic lens. It has been generally accepted in the art that the use of two or more fly cutter blades was necessary for balance and to provide proper performance in a fly cutter type generator wheel. However, due to the price of the polycrystalline segments which are generally used in these wheels. A reduction in polycrystalline segments will drastically reduce the cost of the generator tool. However, the problem in the past is that with reduction of polycrystalline diamond segments used the tool either became unbalanced or did not function properly when cutting a lens curvature.

In addition, the art has continually sought improved methods for cutting and grinding of materials. Therefore, any tool or method which would increase the efficiency of grinding is desirable.

As a particular example, with the increased use of composite or laminate type structural materials in airplanes and the like, it has been necessary to drill holes in materials having two or more layers of dissimilar hardness type materials which are laminated together. The drilling of holes in such composite materials has been a problem, when using conventional drill bits, in that the turnings from the harder materials produced during drilling of the laminate or composite tend to adversely wear the portions of the bore in the softer layers of the composite. Thus, close tolerance holes were sometimes not possible due to this deterioration in the walls forming the bore.

Therefore, it is an object of the present invention to provide an improved method for cutting of composite materials useful in drilling of composite materials and additionally to provide an improved lower cost fly cutting generator wheel.

SUMMARY OF THE INVENTION

In the present invention thee is provided a single blade polycrystalline diamond fly cutter generator wheel. The generator wheel includes a shaft portion and a body portion attached to the shaft portion. The body portion includes a substantially circular outer rim portion which extends therefrom. The outer rim portion has an axially outer edge which is arcuate in its cross section. An abrasive grit material is attached to the outer rim portion for at least covering the arcuate cross-section rim edge portion of the generator wheel. A single polycrystalline cutting edge is affixed to the rim portion. A counterweight means is provided on the rim on the generator wheel for counterbalancing the polycrystalline cutting edge during rotation of the generator wheel. The polycrystalline cutting edge substantially provides for initial forming of an ophthalmic lens curvature by taking off coarse particles or turnings from the ophthalmic lens and the remaining grit material acts to further grind the coarse particles which provides for increased efficiency in grinding and forming of the lens.

In accordance with the method aspects of the present invention, a tool is provided which includes a first cutting blade with an adjacent abrasive grit material attached to the surface adjacent thereto such that the cutting blade cuts off coarse particles and the abrasive grit cooperates to reduce the coarse particles to reduce any potential damage to softer layers when cutting through a composite type material.

The generator wheel of the present invention is thus more cost effective because of the use of only one polycrystalline diamond blade without any loss of speed or efficiencies in forming ophthalmic lenses.

The method of the present invention improves the tolerances for bores cut in composite materials made of layers of different hardness materials.

Further advantages and additional benefits of the present invention will become apparent to those skilled in the art from the subsequent description of the preferred embodiment and the appended claims taken in conjunction with the accompanying drawings.

DESCRIPTION OF THE PREFERRED EMBODIMENTS

Figure 1:
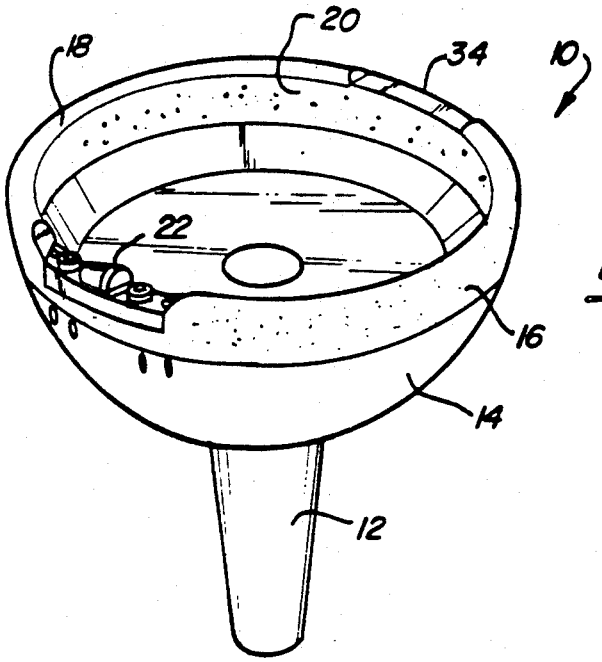
FIG. 1 is a perspective view of a generator wheel made in accordance with the present invention.
Figure 2:
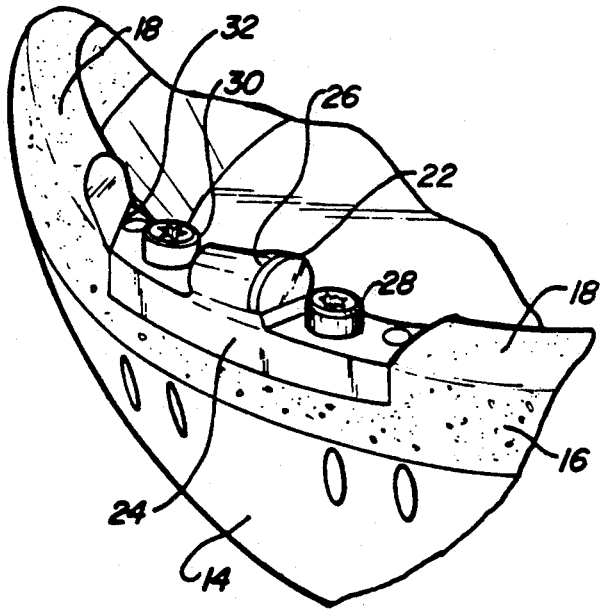
FIG. 2 is a detailed perspective view of the generator wheel of FIG. 1 showing the polycrystalline cutting segment.
Figure 3:
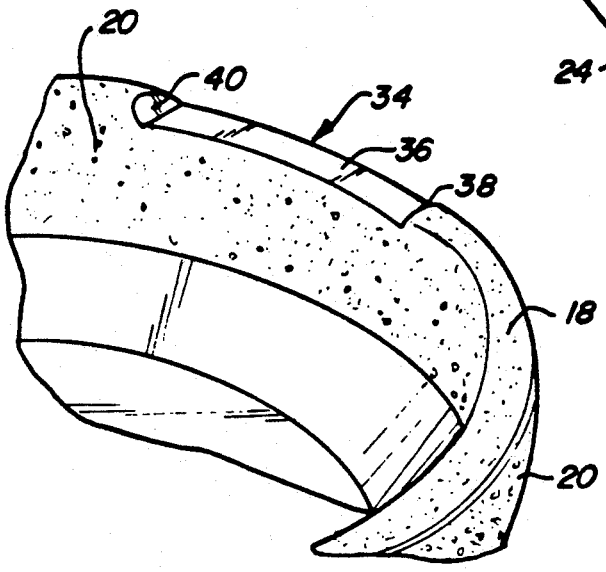
FIG. 3 is a detailed perspective view of the generator wheel of FIG. 1 showing the counterbalance portion of the generator wheel.

According to the present invention, a single blade polycrystalline diamond fly cutter generator wheel 10 is provided. The wheel 10 includes a shaft portion 12. A body portion 14 is attached to the shaft portion 12. The body portion 14 includes a substantially circular outer rim portion 16 which extends from the body portion 14. Rim portion 16 includes an axially outer-most rim portion 18 which has a generally arcuate cross-section. An abrasive grit material 20 is attached to the outer rim portion for at least covering the arcuate edge portion of the generator wheel. The abrasive grit portion may be a monolayer of diamond grit particles or the like attached to the rim portion 18 such as brazing of diamond grit particles or the like. Other types of abrasive grits or methods of attachment may be used to provide an effective abrading surface on the rim portion 16.

A single polycrystalline cutting edge 22 is affixed to the rim portion 16 such that the edge is substantially even with or slightly above the axially outer most portion 18 of the rim 16. The polycrystalline cutting edge 22 is provided on the steel base member 24 and has a steel backing portion 26. Fasteners 28 and 30 are provided to fasten the polycrystalline cutting edge in a suitable opening 32 in the rim portion 16 of the wheel 10. In a preferred embodiment the cutting edge of the polycrystalline insert is slightly above, i.e. approximately 1/16 of an inch, the axially outer most portion of the outer edge 18.

A counterbalance means generally shown at 34 is provided for counterbalancing of the polycrystalline cutting edge during rotation of the generator wheel 10. In a preferred embodiment, the counterbalance means includes the cut-out portion defined by walls 36, 38 and 40 which balances the wheel during use thereof.

In operation, the use of a single blade embodiment is possible because of the cooperative effect between the polycrystalline cutting edge 22 and the abrasive grit material 20 as follows. During a cutting operation as the wheel is rotating the polycrystalline edge 22 cuts off a coarse particle or coarse turning from the ophthalmic lens and thereafter the abrasive grit particles attached to the rim 16 act to further break down the size of the coarse particles into a smaller particle. This provides for increased efficiencies because the particles can be easily removed by vacuuming. Additionally, because the particles are reduced in size they do not detrimentally engage the lens surface, thus an improved finish can be obtained. This cooperative effect provides for the allowance of the use of only one polycrystalline blade. Thus, while the prior art taught that at least two polycrystalline blades were needed to effectively produce a fly cutter wheel the cooperation between a single blade and the abrasive grit material allows the use of only a single blade. This results in a substantial cost savings in the final wheel in that the relatively expensive polycrystalline diamond bit is only utilized in one spot in the wheel of the present invention.

This discovery is also useful in the cutting or boring of composite materials as set forth below. Composite materials, such as a titanium main layer 100 with polymeric laminated layers, such as 102 and 104 are being increasingly utilized in new products. Because the polymeric layers 102 or 104 are softer than the base titanium layer 100, boring holes in such a composite has been a problem.

Figure 6:
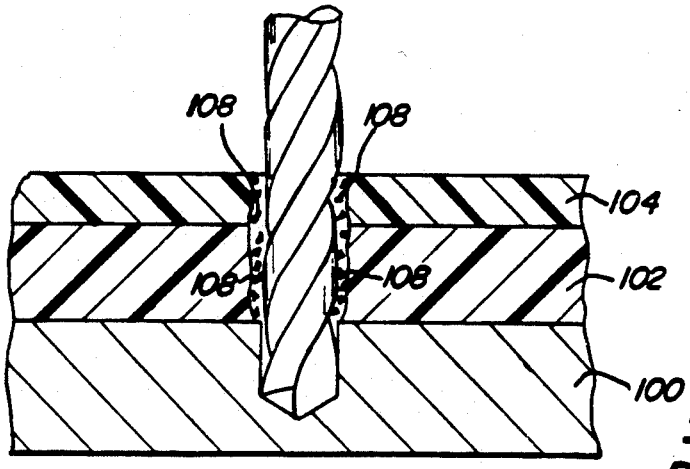
Fig-6 PRIOR ART
FIG. 6 is a view showing the prior art problem with drilling of composite structures.
Figure 4:
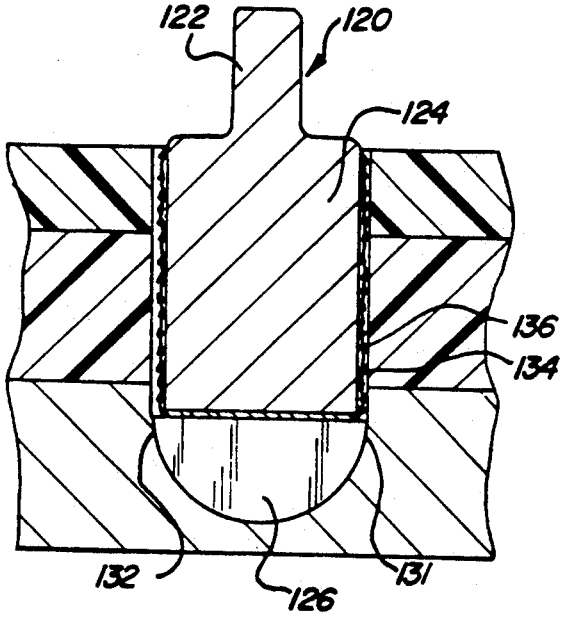
FIG. 4 is a view showing the method of the present invention for cutting or drilling through a composite material.

Referring to FIG. 6, with the use of a conventional drill bit 106 large turnings or particles 108 are generated during the drilling operation. While this does not create problems when proceeding strictly through the soft polymeric layers, such as 102 and 104, upon reaching the titanium layer 100 the harder turnings which are generated tend to cut into the polymeric layers 102 and 104, thus deforming the wall 110 forming the bore. This is undesirable in that close tolerances of such holes are important in most manufacturing operations.

In accordance with the present invention, a method of drilling a bore in a composite structure is provided whereby deterioration of the bore walls in the softer polymeric layers is substantially diminished.

In the method of the present invention a cutting tool is provided having a first rough cutting edge. A second surface is provided which is adjacent to the outer most portion of the cutting edge which has an abrasive grit material attached thereto. The second surface follows the cutting edge during cutting or rotation of the tool when engaging the composite surface.

In a next step of the present invention a tool is used to cut through the composite by moving the cutting edge with respect to the composite and forcing it against the composite. During this cutting movement the cutting edge cuts a coarse turning from the composite material which coarse turning is reduced in size by the adjacent abrasive grit. This provides for smaller particles which will not unduly distort any softer layers such as layers 102 or 104.

Figure 5:
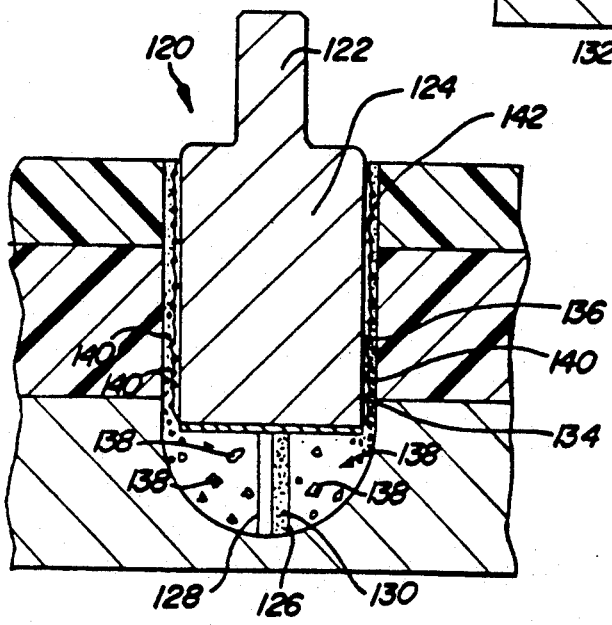
FIG. 5 is a detailed view of FIG. 3 showing the tool rotated 90°.

Thus, referring to the figures, a rotary tool 120 is provided which includes a shaft portion 122 for fitting in a rotary tool, such as a drill for instance. A body portion 124 is provided which has a polycrystalline spade blade cutting edge 126 attached thereto by brazing or welding or the like. The cutting edge 126 includes a metal backing side 128 and a polycrystalline cutting edge side 130. The cutting edge 126 includes radially outer most sides 131 and 132. A surface 134 is provided which is set back from the radially outer most edges 131 and 132. The surface 134 of this tool is cylindrical in nature and includes an abrasive grit material 136 attached thereto. As can be seen from FIG. 5, large turnings or particles 138 are produced during cutting of the bore in the composite material. However, when the particles 138 reach the diamond grit covered surface 134 the diamond grit acts to break them down into smaller particles 140. The smaller particles are broken down and do not detrimentally effect the bore walls 142 forming the hole where it passes through the softer layers 102 and 104.

While the above description constitutes the preferred embodiments of the present invention it is to be appreciated that the invention is susceptible to modification, variation and change without departing from the proper scope and fair meaning of the accompanying claims.

What is claimed is:

1. A process for cutting of a composite work piece comprising the steps of:

a) providing a cutting tool having a first cutting edge having an outermost radial edge and an adjacent surface having an abrasive grit material attached thereof, said abrasive grit material being radially set back from said outermost radial edge of said cutting edge wherein said cutting edge is in a direction ahead of the abrasive grit during a cutting stroke of said tool;

b) moving said tool relative to said work piece such that said cutting edge cuts a large turn the work piece which is thereafter reduced in size by said abrasive grit material whereby improved cutting of the work piece is accomplished.

2. A method of drilling a bore in a composite structure having at least a first layer and a second layer, wherein said first layer is of a lesser hardness than the second layer, said method providing for drilling of the composite article without distortion in the hole in the first layer of lesser hardness, said method comprising the steps of:

a) providing a rotary cutting tool having a first cutting edge having an outermost radial edge and a second surface having an abrasive grit material attached thereto and following said cutting edge during rotation of said rotary cutting tool said abrasive grit being radially set back from said outermost radial edge of said cutting edge;

b) cutting through said composite with said rotary cutting tool by rotating said tool and forcing it against said composite, whereby said cutting edge cuts a coarse turning from either said first or said second layer, said coarse turning being reduced in size by the following abrasive grit such that the particle size of the turnings is reduced such that the reduced size particles do not detrimentally affect the bore size in the softer material.

* * * * *

UNITED STATES PATENT AND TRADEMARK OFFICE

CERTIFICATE OF CORRECTION

PATENT NO. : 5,197,233

DATED : March 30, 1993

INVENTOR(S) : Ronald C. Wiand

It is certified that error appears in the above-identified patent and that said Letters Patent is hereby corrected as shown below:

Column 1, line 26, "wheels.A" should be --wheels, a--

Column 1, line 56, "thee" should be --there--

Column 4, line 36, claim 1, "thereof" should be --thereto--

Column 4, line 42, claim 1, after "turn" insert --from--

Column 4, line 56, claim 2, after "tool" insert --,--

Signed and Sealed this

Fifteenth Day of February, 1994

*Attest:*

Bruce Lehman

BRUCE LEHMAN

*Attesting Officer*

*Commissioner of Patents and Trademarks*